United States Patent [19]

Paredes et al.

[11] Patent Number: 4,520,390

[45] Date of Patent: May 28, 1985

[54] BURNER MONITORING SYSTEM

[75] Inventors: Candelario Paredes, Dallas, Tex.; William D. Stevens, North Caldwell, N.J.

[73] Assignee: Forney Engineering Company, Carrollton, Tex.

[21] Appl. No.: 411,224

[22] Filed: Aug. 25, 1982

[51] Int. Cl.[3] ..... H04H 7/18

[52] U.S. Cl. ..... 358/108; 358/100; 358/107

[58] Field of Search ..... 358/107, 100, 113, 111, 358/108; 431/13, 17, 75; 110/185; 382/8, 9; 250/554

[56] References Cited

U.S. PATENT DOCUMENTS

| | | | |
|---|---|---|---|
| 2,561,197 | 7/1951 | Goldsmith | 178/6.8 |
| 2,909,668 | 10/1959 | Thurlby et al. | 250/213 |
| 3,544,710 | 12/1970 | Poos | 358/100 |
| 4,218,707 | 8/1980 | Reed et al. | 358/113 |

FOREIGN PATENT DOCUMENTS

| | | | |
|---|---|---|---|
| 566182 | 11/1958 | Canada | 358/108 |

OTHER PUBLICATIONS

C. R. Copeman, "Closed-Circuit Television in the Generating Industry" Instrument Practice, Feb. 1966, pp. 135–138.

A. M. Godridge, "Development and Use of a TV System for Viewing Flames" Inst. Physi. Conf., Oct. 1976.

*Primary Examiner*—John C. Martin
*Assistant Examiner*—Edward L. Coles
*Attorney, Agent, or Firm*—Marvin A. Naigur; John E. Wilson; Richard L. Aitken

[57] ABSTRACT

A burner monitoring system in which an array of burners are viewed by a video camera adapted to produce a video signal representing the infrared image of the burner array. The video processing electronics processes the video signal to determine which of the burners is lit and which of the burners is unlit by the presence or absence of hot spots in the infrared image. The video processing electronics generates a video signal which is applied to a cathode ray tube device to generate a visual indication for each of the burners indicating the lit or unlit condition of each of the burners.

10 Claims, 7 Drawing Figures

BURNER MONITORING SYSTEM

BACKGROUND AND SUMMARY OF THE INVENTION

This invention relates to a burner monitoring system and, more particularly, to a system for simultaneously monitoring a multiplicity of burners arranged in array.

An industrial furnace of the type, for example, employed in boilers, comprises a multiplicity of individual burners arranged in an array of rows and columns. For example, a typical arrangement of 16 burners would be arranged in a four by four array. In such a burner array, it is necessary to have an accurate indication of whether or not a flame is present at each individual burner. Prior to the present invention, this need has been satisfied by providing one or more flame detectors at each burner arranged to individually view the flame produced by the burner.

In accordance with the present invention, a video camera is arranged to view the entire array of burners. Each individual burner flame has a hot spot in the center of the flame which will produce a characteristic brightness in a video image of the array. A burner which does not have a flame will not have this hot spot aligned with the burner opening even though flames from the surrounding burners extend in front of the burner with no flame. The video signal produced by the camera is fed to a video electronic system which processes the video signal to detect the presence or absence of the hot spot for each of the burners in the array. The video electronics system produces a video output signal to a cathode ray tube display device to cause the cathode ray tube display device to display an image, which indicates for each of the burners whether or not a flame is present.

The cathode ray tube display is divided into rectangular sections, one for each of the burners, with the sections located in the same relative position in the display that the burners occupy in the array as viewed by the video camera. If a flame is present, as indicated by the presence of the hot spot over the burner, the presence of the hot spot is indicated in the corresponding rectangular section of the display by a green circle in the middle of the section surrounded by a yellow background. If no flame is present, the entire corresponding section in the video display is made red and the letters OFF are generated in the middle of the section. With the above described arrangement, the need for separate flame detectors for each of the burners is eliminated and the presence and absence of a flame emanating from each of the individual burners is accurately detected and indicated.

DESCRIPTION OF THE PREFERRED EMBODIMENTS

Figure 1:
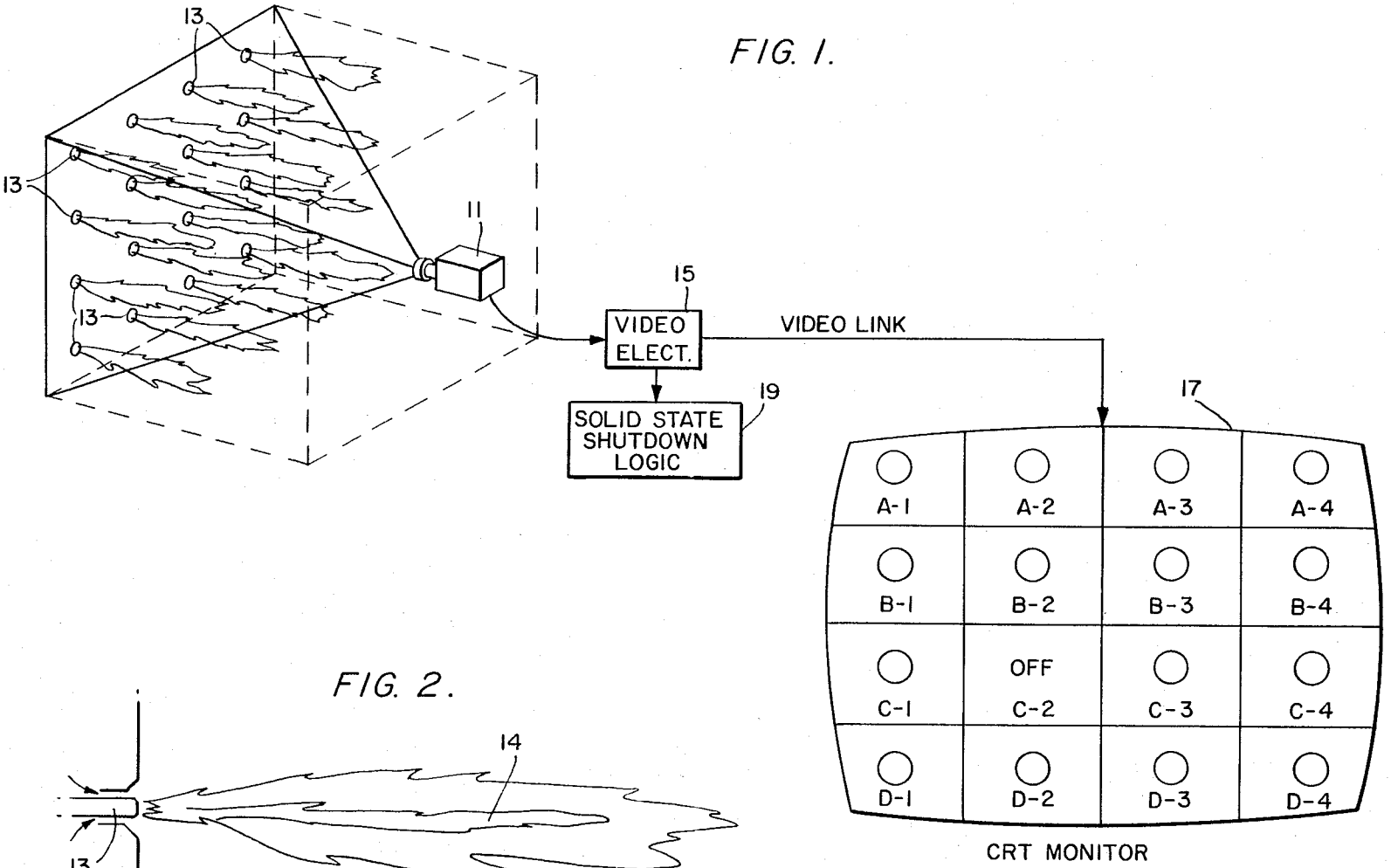
FIG. 1 is a schematic diagram illustrating the system of the present invention.
Figure 2:
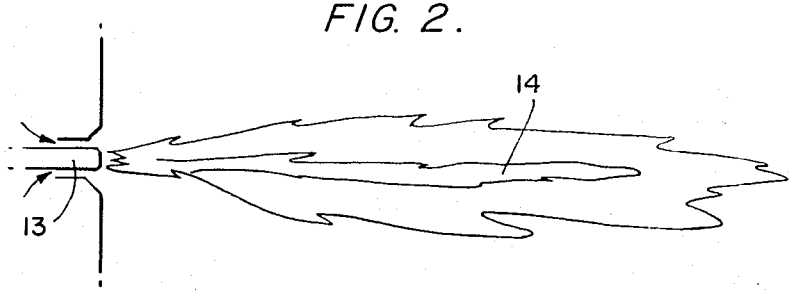
FIG. 2 is a sectional view of the flame issuing from a burner monitored by the system of the present invention.

As shown in FIG. 1, in the specific embodiment of the present invention, a video camera 11 is provided to view a 4×4 array of 16 gas burners 13. The camera is positioned so that all 16 burners are in the field of view of the camera. In the preferred embodiment, the camera 11 is provided with an infrared filter and is adapted to be sensitive only to infrared light so that the video signal generated by the camera 11 represents the infrared image of the burners 13. While the flame issuing from each burner may vary considerably in shape and position with time, and even extend in front of an adjacent burner, each flame, as shown in FIG. 2, has a small hot spot 14 in the middle of the flame which remains aligned with the burner opening. These hot spots will each produce a bright circular spot in the infrared image of the burner represented by the video signal produced by the camera 11.

The video signal produced by the camera 11 is applied to video processing electronics 15 which processes the applied video signal to detect the presence or absence of the bright spot in the infrared image for each of the burners 13 and thus detects whether or not each of the burners is on or off. The video processing electronics 15 also generates a video signal which is applied to a cathode ray tube video display device 17 to cause it to display an indication for each of the burners of whether or not the burner is off.

The display indication by the display device 17 represents the burners in the 4×4 array as viewed by the camera 11. The screen of the display device, as illustrated in FIG. 1, is divided into 16 rectangular areas, one for each of the burners in the corresponding position that the burner occupies in the burner array. Each of the burners is designated by its row and column position A-1 through A-4, B-1 through B-4, C-1 through C-4 and D-1 through D-4 and these burner designations appear in the displays for each burner. If the burner is on, then the corresponding area of the display device 17 will have a green circular image 18 in the center of the area surrounded by a yellow background. If a burner is unlit or off, then the corresponding area on the screen of the display device 17 will be colored red and the word "OFF" will appear in the middle of the corresponding area to indicate that the burner is off. Thus, in the example illustrated in FIG. 1, the burner C-2 is off and this condition is indicated by the area corresponding to this burner being colored red as a background to the word "OFF". The video processing system 15 also applies signals to a solid state shut-down logic system 19 indicating which of the burners is off and if a preselected number of the burners are off, the solid state shut-down logic system 19 will shut down the burner operation.

Figure 3:
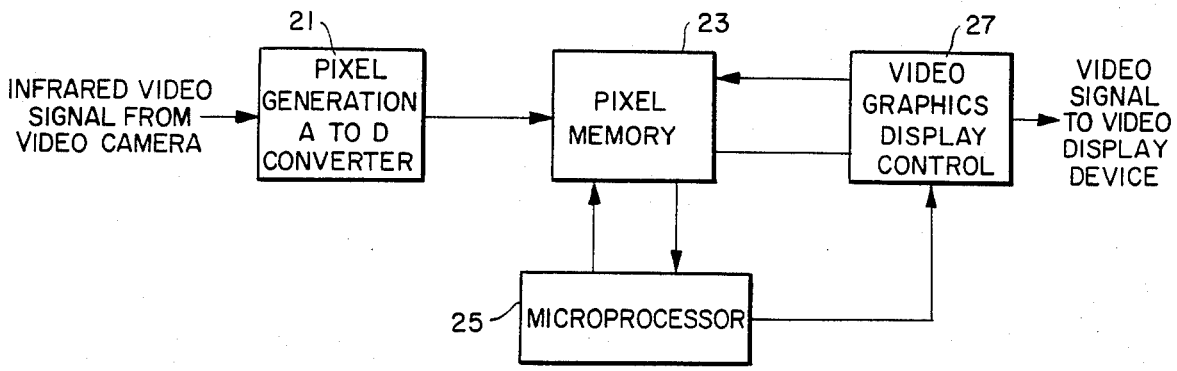
FIG. 3 is a block diagram showing the video processing electronics of the system of the invention in more detail.

In the video processing electronics 15, as shown in FIG. 3, the video signal from the camera 11 is applied to a pixel converter 21, which is an analog-to-digital converter and which divides the applied video signal into pixels and generates a four bit binary signal representing the brightness of each pixel as one of 16 different degrees of brightness. Each of 256 video scan lines making up one image frame is divided into 512 pixels so that the infrared image represented by the output signal of the camera 11 representing one image frame is divided into 131,072 pixels with each pixel representing the characteristic brightness of 1/512 of a scan line in the infrared image. The digitally represented pixels are applied to and stored in a pixel memory 23.

A microprocessor 25 is programmed to read out those pixels in the memory 23 corresponding to the hot spot areas in the infrared image where a bright spot would occur for each of the burners if the burner flame were present as a result of the characteristic hot spot in the burner flame. If the flame from the burner is present, the pixels representing the hot spot area, which is a circular area aligned with the burner, will all have a brightness value near the maximum brightness value. The microprocessor reads out all the pixels in the hot spot area for each burner and compares each pixel read out with a comparison brightness value, which is selected so that if a burner is on, the pixel brightness value will exceed the selected comparison value and if the burner is off, the pixel brightness value will be less than the selected comparison value. The microprocessor counts for each burner the number of pixels in the hot spot area which exceed the comparison value. If 90 percent of the pixels in a hot spot area for a given burner exceed the comparison value, the microprocessor determines that the burner is on and if less than 90 percent of the pixels in the hot spot area exceed the comparison value, the microprocessor determines that the burner is off.

Figure 4:
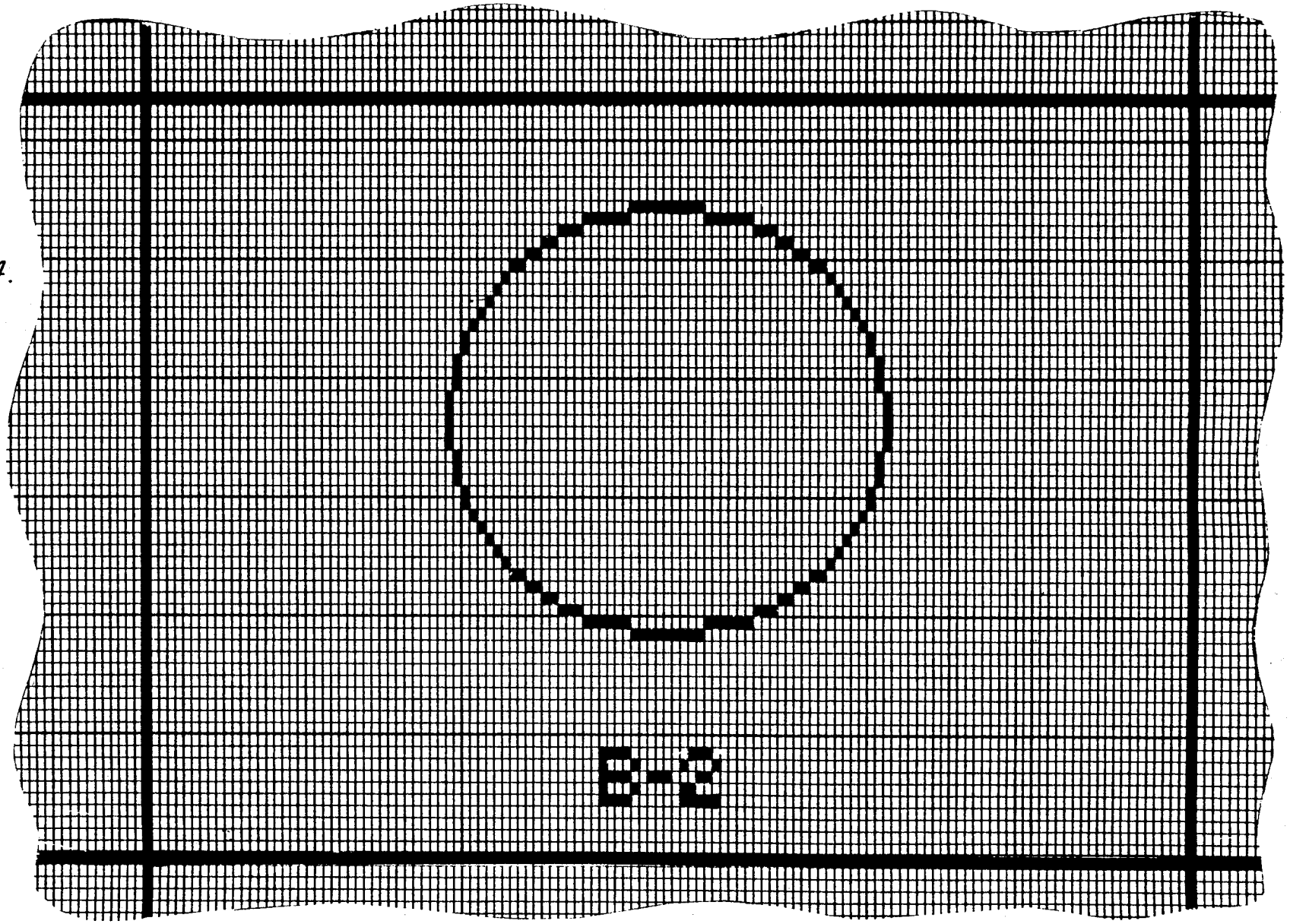
FIG. 4 is an enlarged view showing the pixel display of the ON condition of one of the burners in accordance with the present invention.

The microprocessor applies signals to a video graphic display system 27 indicating which of the 16 burners have been determined to be on and which of the 16 burners have been determined to be off. The video graphics system 27 also uses pixels to generate the video signal to produce the display on the video display device 17 to indicate the on/off condition of each of the burners. FIG. 4 is an enlarged view of the portion of the display produced on the display device 13 for the burner B-2 when the burner B-2 is on or lit. The circular area is green and is surrounded by a yellow background color, which is separated from the green circular area by a black line one pixel wide. The fine lines in FIG. 4, which divide the illustration into tiny rectangles, show how the display is divided into pixels. These fine lines are not visible in the actual video display. As shown in FIG. 4, the display for one burner is 127 pixels wide and 63 pixels high and contains $127 \times 63 = 8{,}001$ pixels not counting the black lines which are one pixel wide dividing the individual burner display areas. The green circular area in the center of the individual burner display as shown in FIG. 4 corresponds in size and position to the hot spot area in the infrared image of the burner.

The graphics display system 27 is operable to read out the pixels stored in the memory 23 and generate a video signal from these pixels to represent the ON condition of the burners. The system actually uses only those pixels in the memory 23 representing the hot spot areas in the infrared image and these pixels which have the characteristic hot spot brightness in the stored infrared image are displayed as green circles in the displayed image, as described with reference to FIG. 4. The remaining pixels in the memory 23 outside of the hot spot areas are masked out and the graphics display system generates the black line around the green circular area surrounded by the yellow background color in place of all the remaining pixels for each burner that is in service.

The graphics display system 27 has its own pixel memory storing a complete set of pixels to generate a video signal representing the off condition for each of the burners and the video graphics system is operable to read out these pixels and generate a video signal to represent the off condition in each of the individual burner display areas as described above with reference to FIG. 1. The graphics display system 27, in response to the signals received from the microprocessor 25 indicating which of the burners are in or out of service, switches back and forth between the pixels representing the on condition of the burners and the pixels representing the off condition to generate the appropriate display to represent the condition of each of the burners in each of the individual display areas.

While the above described display system is in accordance with the preferred embodiment, it will be appreciated that other systems for displaying the on/off condition burners may be used. For example, a display could be employed in which the pixels surrounding the hot spot areas are not masked out from the display to represent the condition of the burners in service. Alternatively, instead of using a cathode ray display system, other forms of displays could be provided such as indicator lights controlled in accordance with the output signals of the microprocessor.

Figure 5:
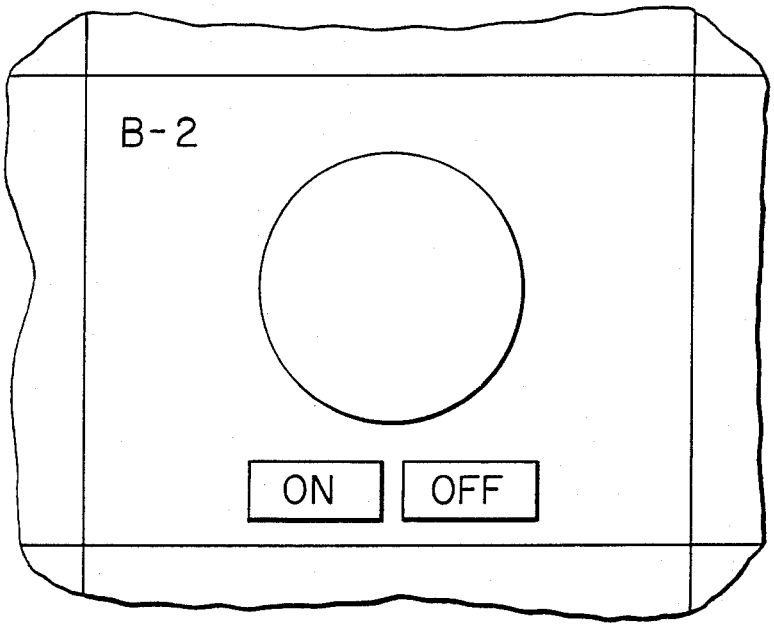
FIG. 5 illustrates the ON condition display of one of the burners in accordance with a modification of the invention employing a touch sensitive screen to control the ON/OFF condition of each burner.
Figure 6:
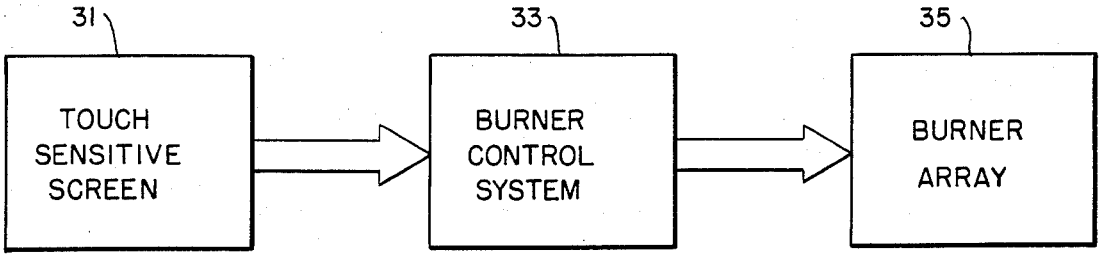
FIG. 6 is a block diagram illustrating the burner control system responsive to a touch sensitive screen as shown in FIG. 5.

In accordance with a modification of the present invention, the video display device 17 is provided with a touch sensitive screen. Two touch sensitive target areas are provided in each of the individual burner display areas. The graphics display system causes these touch sensitive target areas to be outlined and one labeled "OFF" and one labeled "ON" in each of the burner display areas as shown in FIG. 5 which illustrates one of the burner display areas. These outlined target areas will appear in both the display for the burner ON condition and the burner OFF condition. As shown in FIG. 6, which illustrates the touch sensitive control system, the touch sensitive screen 31 of the system is connected with a touch responsive burner control system 33. The burner control system 33 responds to the touching of the target area labeled "ON" in an individual burner display area to ignite the corresponding burner in the array of burners designated 35 in FIG. 6 provided all required permissives have been satisfied. Likewise, the burner control system 33 will operate in response to the touching of the target area labeled "OFF" in an individual burner display area to turn the corresponding burner off. The touch responsive control system 33 is like that disclosed in copending application Ser. No. 255,842 entitled "INDUSTRIAL PROCESS CONTROL SYSTEM" and invented by Billy R. Slater, Dennis W. Simpson and Clearence T. Carroll. The disclosure of this application is hereby incorporated by reference.

Figure 7:
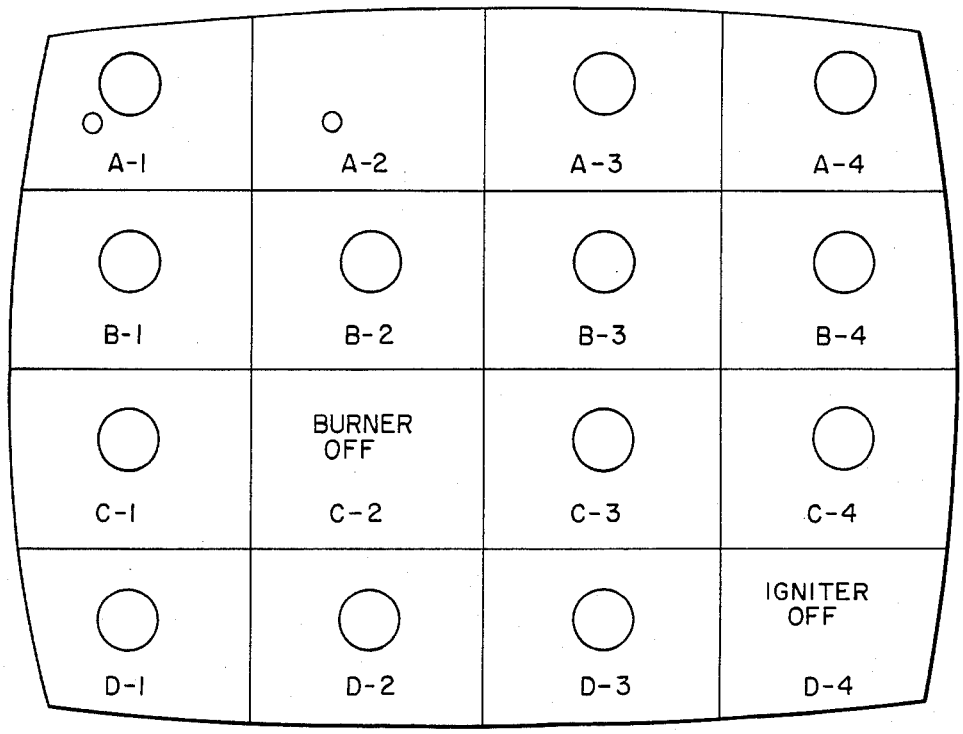
FIG. 7 is an illustration of the CRT tube display for another modification of the system shown in FIG. 1.

In addition to detecting the on/off condition of each burner, the invention, as shown in FIG. 1, can also detect the on/off condition of the burner ignitors. Each burner will generally have positioned adjacent thereto a burner ignitor, which is often fueled by the same fuel that fuels the burner. In the process of igniting a burner, fuel is first supplied to the ignitor after all permissives have been met and the ignitor is lit. Fuel is then supplied to the burner and the flame issuing from the ignitor ignites the burner. When the burner ignitor is lit, it, like the burner, will produce a hot spot and this hot spot will produce a characteristic bright spot in the infrared image produced by the video camera. To indicate the on/off condition of the ignitor as well as the burner, the video electronics 15 is designed to detect the presence or absence of the bright spots produced by the ignitors in the infrared image as represented by the video signal and to generate a corresponding display indication of the on/off condition of the ignitor for each burner in the CRT monitor 17. If the ignitor of a given burner is on, the corresponding section of the video display produced by the CRT monitor 17 will include a small displayed circle at the position of the ignitor indicating that the ignitor is on. If both the ignitor and the burner are on, then both the circle for the burner flame and the circle for the ignitor will be exhibited. If only the burner is on, then only the large circle for the main burner flame will be displayed. If both the ignitor and the burner flame are off, then the corresponding section of the CRT monitor display will contain the legend "burner off", or under certain conditions, the legend "ignitor off" will be displayed. The legend "ignitor off" is displayed when the control system for the burner is trying or has tried unsuccessfully to ignite the ignitor and the ignitor has remained off. Thus, as shown in FIG. 7 illustrating the display for such a system, the burner A-1 has both the burner and the ignitor on, the burner A-2 has only the ignitor on; the burner C-2 has both the burner and the ignitor off; and the burner D-4 has both the burner and the ignitor off and the burner control system is trying or has tried unsuccessfully to light the ignitor. The remaining burners have only the burners on. It will be appreciated that the touch sensitive screen burner control system illustrated in FIGS. 5 and 6 is applicable to a system in which the on/off condition of both the burner and the burner ignitor are displayed, as described with reference to FIG. 7.

As described above, the camera 11 is preferably made sensitive to only infrared light as this provides the best results. However, the concept of the invention is also applicable to the visual light and infrared light generated by the array. Accordingly, in an alternative embodiment, the camera 11 is made sensitive to visual light and in another alternative embodiment, the camera 11 is provided with an ultraviolet filter to make it sensitive to only ultraviolet light. In these alternative embodiments, the hot spots of the burner flames will also produce characteristic image spots in the video image of the burner array and the video image is processed by the video electronics 15 in substantially the same manner as the infrared video image.

In the above-described specific embodiments of the invention, the burners are gas burners. However, it should be understood that the invention is equally applicable to burner arrays firing other fuels, such as, for example, oil, coal, and coal and oil mistures.

Many modifications may be made to the above described specific embodiments of the invention without departing from the spirit and scope of the invention, which is defined in the appended claims.

What is claimed is:

1. A burner monitoring system comprising an array of burners, each of said burners when lit producing a flame with a hot spot having a characteristic brightness in alignment with such burner different than the brightness of the remainder of said flame and smaller than said flame, video camera means positioned to view said array of burners and generate a video signal representing an image of the lit ot unlit condition of each of said burners, means responsive to said video signal to determine whether a hot spot having said characteristic brightness is in alignment with each of said burners and generate a first predetermined signal indication for each of said burners to indicate that such burner is lit when a hot spot with said characteristic brightness is present in aligment with such burner and a second predetermined signal indication to indicate that such burner is unlit when a hot spot with a said characteristic brightness is not present in alignment with such burner.

2. A burner monitoring system as recited in claim 1, further comprising means responsive to said signal indication to visually indicate the lit or unlit condition of each of said burners.

3. A burner monitoring system as recited in claim 2, wherein said means to visually indicate the lit or unlit condition of said burners comprises a cathode ray tube display device comprising means to visually indicate the lit or unlit condition of each of said burners in a separate area on the screen of said cathode ray tube display device.

4. A burner monitoring system as recited in claim 1, wherein said image of the lit or the unlit condition of said burners is an infrared image.

5. A burner monitoring system as recited in claim 4, wherein said means to determine the lit and unlit condition of each of said burners comprises means to compare the brightness of said video signal representing the predetermined hot spot for each burner in said image with a predetermined brightness value selected to be less than the brightness of said video signal from said hot spot when said burner is lit and to be greater than the brightness of the video signal from said hot spot when such burner is unlit.

6. A burner monitoring system as recited in claim 5, wherein said means to compare the brightness of said video signal with a predetermined brightness value divides said video signal into pixels and compares the pixels representing the hot spot for each of said burners with said predetermined brightness value.

7. A burner monitoring system as recited in claim 1, wherein said video camera means is responsive to only the infrared light emitted by said burners and generates a video signal representing the infrared image of the lit or unlit condition of each of said burners.

8. A burner monitoring system as recited in claim 1, wherein said video camera means is responsive to the visual light emitted by said array of burners to generate said video signal representing said image.

9. A burner monitoring system as recited in claim 1, wherein said camera means is responsive to only the ultraviolet light emitted by said array of burners to generate a video signal representing an ultraviolet image of the lit or unlit condition of each of said burners.

10. A burner monitoring system comprising an array of burners, video camera means to view said array of burners and generate a video signal representing an image of the lit or unlit condition of each of said burners, means responsive to said video signal to determine whether each of said burners is lit or unlit and generate a first predetermined signal indication for each of said burners to indicate that such burner is lit and a second predetermined signal indication to indicate that such burner is unlit, and a cathode ray tube display device comprising means responsive to said signal indication to visually indicate the lit or unlit condition of each of said burners in a separate area on the screen of said cathode ray tube display device.

* * * * *